US010648143B2

(12) United States Patent
Ding et al.

(10) Patent No.: US 10,648,143 B2
(45) Date of Patent: May 12, 2020

(54) ADJUSTMENT MECHANISM FOR DEICING UNIT, DEICING UNIT, DEICING VEHICLE AND DEICING METHOD

(71) Applicant: Mengchun Ding, Beijing (CN)

(72) Inventors: Chao Ding, Henan (CN); Suiping Yang, Beijing (CN)

(73) Assignee: Mengchun Ding, Beijing (CN)

( * ) Notice: Subject to any disclaimer, the term of this patent is extended or adjusted under 35 U.S.C. 154(b) by 261 days.

(21) Appl. No.: 15/827,380

(22) Filed: Nov. 30, 2017

(65) Prior Publication Data

US 2018/0080187 A1 Mar. 22, 2018

Related U.S. Application Data

(63) Continuation-in-part of application No. PCT/CN2016/083457, filed on May 26, 2016.

(30) Foreign Application Priority Data

Jun. 1, 2015 (CN) ..... 2015 1 0292182
May 23, 2016 (CN) ..... 2016 1 0344024

(51) Int. Cl.
*E01H 5/12* (2006.01)
*E01H 5/09* (2006.01)
(Continued)

(52) U.S. Cl.
CPC ..... *E01H 5/12* (2013.01); *E01H 5/098* (2013.01); *E01H 5/106* (2013.01); *E01H 5/062* (2013.01)

(58) Field of Classification Search
CPC ..... E01H 5/12; E01H 5/098; E01H 5/106; E01H 5/062; A01B 45/00; A01B 45/02; A01B 45/026
(Continued)

(56) References Cited

U.S. PATENT DOCUMENTS 355,405 A * 1/1887 Lillie ..... A01B 27/00 172/65
D83,811 S * 3/1931 Karl ..... D15/29
(Continued)

FOREIGN PATENT DOCUMENTS

CA 2398418 A1 * 2/2003 ..... E01H 5/12
CN 2469044 Y 1/2002
(Continued)

OTHER PUBLICATIONS

International Search Report dated Sep. 7, 2016 in PCT/CN2016/083457 by the International Searching Authority.
(Continued)

*Primary Examiner* — Jamie L McGowan
(74) *Attorney, Agent, or Firm* — Hultquist, PLLC; Steven J. Hultquist

(57) ABSTRACT

Provided are a deicing unit adjustment mechanism, a deicing unit, a deicing vehicle, and a deicing method. The adjustment mechanism comprises sub-adjustment unit(s) comprising a positioning wheel, a screw rod, a guide rod having one end connected with the screw rod, an upper-end cover slidably arranged at one end of the screw rod away from the guide rod, a lower-end cover fixedly arranged at one end of the screw rod close to the guide rod, a positioning wheel-adjustment spring sleeved outside the screw rod and having two ends abutting against the upper- and lower-end covers and a pressure-adjusting nut at one end of the screw rod away from the guide rod and one side of the upper end cover away from the guide rod. The positioning wheel is rotatably-arranged at other end of the guide rod, with an axis of the positioning wheel perpendicular to that of the guide rod.

19 Claims, 4 Drawing Sheets

(51) Int. Cl.
*E01H 5/10* (2006.01)
*E01H 5/06* (2006.01)

(58) Field of Classification Search
USPC ..... 301/133, 136; 74/127; 248/405; 403/48, 109.4, 111
See application file for complete search history.

(56) References Cited

U.S. PATENT DOCUMENTS 1,879,193 A * 9/1932 Graham ..... A01B 35/28 172/557
2,459,982 A * 1/1949 Wells ..... B64C 25/60 244/102 R
2,606,011 A * 8/1952 Lommen ..... E01H 5/12 299/25
2,796,819 A * 6/1957 Johnson ..... A01B 39/22 172/540
2,911,737 A * 11/1959 Von Arx ..... E01H 5/12 37/232
2,981,341 A * 4/1961 Dilworth ..... A01B 63/1145 172/2
3,065,803 A * 11/1962 Pierson ..... A01B 63/22 172/413
3,094,315 A * 6/1963 Yetter ..... E01H 5/12 299/25
3,115,714 A * 12/1963 Johann ..... E01H 5/04 37/250
3,142,915 A * 8/1964 Curlett ..... E02F 3/841 172/4.5
3,191,369 A * 6/1965 Cowan ..... A01D 57/01 56/14.8
3,239,954 A * 3/1966 Brier ..... E01H 5/04 37/251
3,390,726 A * 7/1968 Johannsen ..... A01B 5/14 172/212
3,475,056 A * 10/1969 Jones ..... E01H 5/12 299/24
3,486,565 A * 12/1969 Heckathorn ..... A01B 21/08 172/572
3,515,219 A * 6/1970 Jackson ..... A01B 39/19 172/44
3,847,437 A * 11/1974 Williams ..... E01H 5/12 299/25
4,047,576 A * 9/1977 Rau ..... A01B 29/041 172/540
4,058,170 A * 11/1977 Ankenman ..... A01B 61/00 172/311
4,099,576 A * 7/1978 Jilani ..... A01B 15/16 172/555
4,178,005 A * 12/1979 Kent, Jr. ..... B60B 33/04 172/417
4,536,002 A * 8/1985 Osborn ..... A01M 7/005 280/43.18
4,720,223 A * 1/1988 Neights ..... B25B 13/481 411/11
5,558,164 A * 9/1996 Clymer ..... A01B 73/02 16/287
5,813,152 A * 9/1998 Weight ..... E01H 5/08 37/249
6,237,695 B1 * 5/2001 Pierce ..... A01B 35/16 172/79
6,805,205 B1 * 10/2004 Gabard ..... A01B 45/02 172/21
8,794,345 B2 * 8/2014 Knobloch ..... A01C 5/066 172/604
2004/0188108 A1 * 9/2004 Thompson, Sr. ..... A01B 1/065 172/25
2008/0030064 A1 * 2/2008 Charbonneau ..... E01H 5/12 299/25
2008/0066662 A1 * 3/2008 Hesla ..... A01C 5/064 111/164
2010/0083628 A1 * 4/2010 Humphrey ..... A01B 45/026 56/249.5
2013/0264080 A1 * 10/2013 Keigley ..... A01B 63/008 172/431

FOREIGN PATENT DOCUMENTS

| | | | | |
|---|---|---|---|---|
| CN | 201024404 Y | 2/2008 | | |
| CN | 201174868 Y | 1/2009 | | |
| CN | 201649031 U | 11/2010 | | |
| CN | 104846768 A | 8/2015 | | |
| CN | 204662339 U | 9/2015 | | |
| CN | 204662340 U | 9/2015 | | |
| CN | 204662341 U | 9/2015 | | |
| CN | 105839579 A | 8/2016 | | |
| DE | 2618909 A1 * | 11/1977 | ..... | E01H 5/12 |
| GB | 798792 A * | 7/1958 | ..... | E01H 5/12 |
| WO | 2016192570 A1 | 8/2016 | | |

OTHER PUBLICATIONS

English Translation of the International Search Report dated Sep. 7, 2016 in PCT/CN2016/083457 by the International Searching Authority.
First Office Action issued in Chinese Patent Application No. 201610344024.8.
English Translation of the First Office Action issued in Chinese Patent Application No. 201610344024.8.
First Office Action issued in Chinese Patent Application No. 201510292182.9.
English Translation of the First Office Action issued in Chinese Patent Application No. 201510292182.9.
Second Office Action issued in Chinese Patent Application No. 201510292182.9.
English Translation of the Second Office Action issued in Chinese Patent Application No. 201510292182.9.
Notification to Grant Patent Right for Invention issued in Chinese Patent Application No. 201610344024.8.
English Translation of Notification to Grant Patent Right for Invention issued in Chinese Patent Application No. 201610344024.8.
Notification to Grant Patent Right for Invention issued in Chinese Patent Application No. 201510292182.9.
English Translation of the Notification to Grant Patent Right for Invention issued in Chinese Patent Application No. 201510292182.9.

* cited by examiner

ADJUSTMENT MECHANISM FOR DEICING UNIT, DEICING UNIT, DEICING VEHICLE AND DEICING METHOD

CROSS REFERENCE TO RELATED APPLICATIONS

This is a continuation-in-part application under 35 U.S.C. § 120 of International Patent Application No. PCT/CN2016/083457 filed May 26, 2016 entitled "Adjustment Mechanism for De-Icing Unit, De-Icing Unit and De-Icing Device", which in turn claims priority of Chinese Patent Application No. 201510292182.9 filed Jun. 1, 2015 entitled "Application Shovel Wheel of Deicing Device", and to Chinese Patent Application No. 201610344024.8 filed May 23, 2016 entitled "Regulating Mechanism of Deicing Unit, Deicing Unit and Deicing Device". The disclosures of such international patent application and Chinese priority patent applications are hereby incorporated herein by reference in their respective entireties, for all purposes.

TECHNICAL FIELD

The present invention relates to the field of deicing machines, and in particular to an adjustment mechanism for a deicing unit, a deicing unit, a deicing vehicle, and a deicing method.

BACKGROUND ART

Current road deicing equipment is roughly divided into two modes, namely, rolling compaction type and shoveling type.

The rolling compaction type deicing equipment consists of two parts which are a drive unit and a deicing unit. The drive unit is mostly formed by modifying a selected developed engineering machine, for example, detaching a bucket from an engineering loader. The deicing unit is formed by evenly arranging and welding N deicing blades around a metal drum and is rolled forward by the action of the drive unit, and the deicing blades in turn perform the rolling compaction on the frozen ice to achieve deicing. Although such products are different in factors such as shapes, geometric dimensions, etc., they are constructed on substantially the same principle.

The shoveling type deicing equipment is substantially the same with the rolling compaction type deicing equipment as for the drive unit, and the deicing unit thereof works on the principle that the horizontal rotational movement of a shaft is converted into upward and downward reciprocating linear movements to drive the deicing blades to strike the frozen ice so as to accomplish the purpose of deicing.

During the deicing operations of the above two types of products, the deicing blades act perpendicularly on the frozen ice and the road surface, in which case there are two possibilities that the deicing unit has a relatively light weight so that the frozen ice cannot be effectively removed, and that the deicing unit has a relatively heavy weight so that the frozen ice is removed and at the same time the road surface is also damaged. Moreover, in the same transverse section subjected to the operation, there will be a simultaneous superposition of factors such as different road surface heights, different ice thicknesses and hardness, etc., resulting in an increased probability of damage to the road surface.

DISCLOSURE OF THE INVENTION

An object of the present invention is to provide an adjustment mechanism for a deicing unit to solve technical problems existing in the prior art.

A further object of the present invention is to provide a deicing unit comprising the adjustment mechanism described above and having all the functions of the adjustment mechanism.

Another object of the present invention is to provide a deicing vehicle comprising the deicing unit described above and having all the functions of the deicing unit.

Another object of the present invention is to provide a deicing method by which rapid deicing can be achieved without damaging the road surface.

Embodiments of the present invention are implemented as follows:

An embodiment of the present invention provides an adjustment mechanism for a deicing unit, which comprises at least one sub-adjustment unit, each sub-adjustment unit comprises a positioning wheel, a guide rod, a screw rod, a positioning wheel adjustment spring, an upper end cover, a lower end cover, and a pressure adjusting nut;

the positioning wheel is rotatably arranged at one end of the guide rod, and an axis of the positioning wheel is perpendicular to an axis of the guide rod;

the other end of the guide rod is connected with one end of the screw rod;

the positioning wheel adjustment spring is sheathed sleeved outside the screw rod, and one end of the positioning wheel adjustment spring abuts against the upper end cover, and the other end of the positioning wheel adjustment spring abuts against the lower end cover;

the upper end cover is slidably arranged at one end of the screw rod away from the guide rod;

the pressure adjusting nut is arranged at the one end of the screw rod away from the guide rod and at one side of the upper end cover away from the guide rod, and the pressure adjusting nut is configured to adjust the maximum distance between the upper end cover and the lower end cover, and can preload the positioning wheel adjustment spring; and the lower end cover is fixedly arranged at one end of the screw rod close to the guide rod.

Optionally, the sub-adjustment mechanism further comprises a guide rod adjusting nut;

one end of the guide rod adjusting nut is connected with the guide rod, and the other end of the guide rod adjusting nut abuts against one side of the lower end cover away from the positioning wheel adjustment spring, and the guide rod adjusting nut is configured to adjust the distance between the guide rod adjusting nut and the lower end cover, so as to adjust the height of the guide rod.

Optionally, the sub-adjustment mechanism further comprises a base;

the base is provided with a positioning hole;

the guide rod is slidably connected with the base through the positioning hole.

Optionally, the sub-adjustment mechanism further comprises a main frame and a first adjustment mechanism;

the first adjustment mechanism comprises a suspension bracket, a hydraulic cylinder, a hydraulic cylinder transverse arm, at least one first sub-adjustment unit and a suspension boom, each first sub-adjustment unit comprises a main adjustment spring, a main adjustment screw rod, a main adjustment nut and a spring base;

one end of the hydraulic cylinder is rotatably connected with the main frame, and the other end of the hydraulic cylinder is rotatably connected with the hydraulic cylinder transverse arm;

the main adjustment screw rod has one end passing through the suspension bracket and is slidably connected with the suspension bracket;

one end of the main adjustment screw rod is fixedly connected with the hydraulic cylinder transverse arm, and the other end of the main adjustment screw rod is slidably connected with the spring base;

the main adjustment spring is sleeved outside the main adjustment screw rod, and one end of the main adjustment spring abuts against the spring base, and the other end of the main adjustment spring abuts against the suspension bracket; and the main adjustment nut is arranged at one end of the main adjustment screw rod and is arranged at one side of the spring base away from the main adjustment spring.

Optionally, a lifting spring is further sleeved outside the main adjustment screw rod;

one end of the lifting spring abuts against the suspension bracket, and the other end of the lifting spring abuts against the hydraulic cylinder transverse arm.

Optionally, the adjustment mechanism for a deicing unit further comprises a second adjustment mechanism;

the second adjustment mechanism comprises a cross shaft, fixation seats, a boom transverse arm, balance springs, and a pressure transmission adjusting assembly;

two opposite ends of the cross shaft are provided with the fixation seats respectively, and the other two ends of the cross shaft are rotatably connected with middle portions of two suspension booms respectively;

one end of each of the suspension booms is rotatably connected with the suspension bracket, and the other end of each of the suspension boom is connected with one end of the boom transverse arm;

the pressure transmission adjusting assembly is arranged at one side of the boom transverse arm close to the main frame;

one end of each of the balance spring is fixedly arranged on the main frame, and the other end of each of the balance spring is arranged opposite to a respective end of the boom transverse arm;

the fixation seats are fixedly arranged on the main frame;

one side of the cross shaft away from the main frame is rotatably connected with one end of the hydraulic cylinder;

the boom transverse arm is provided with limit adjusting bolts;

the limit adjusting bolts are each arranged opposite to the respective balance spring.

Optionally, the pressure transmission adjusting assembly comprises an adjusting plate and an adjusting block;

the adjusting block is semicircular;

the adjusting block is fixedly arranged on the main frame;

the adjusting block has an arc surface arranged at one side close to the boom transverse arm;

the adjusting plate is an arc-shaped plate; and one side of the adjusting plate is fixedly arranged on the boom transverse arm, and the other side of the adjusting plate abuts against the arc surface of the adjusting block.

An embodiment of the present invention provides a deicing unit, which comprises a main frame, a driving spindle, a driving motor, at least one deicing wheel (i.e. the wheel provided inside the main frame), a plurality of deicing blades, and the adjustment mechanism described above;

the driving motor is arranged at one end of the driving spindle and fixedly arranged on the main frame;

each deicing wheel is coaxially and fixedly arranged on the driving spindle;

the plurality of deicing blades are evenly arranged in a circumferential direction of the deicing wheel with an axis of the deicing wheel as a central axis;

the upper end cover is fixedly arranged on the main frame; and an axis of the positioning wheel is parallel to an axis of the driving spindle.

Optionally, the deicing blade comprises a connecting shank and a blade head;

one end of the connecting shank is rotatably connected with the deicing wheel;

the other end of the connecting shank is fixedly connected with a side portion at one end of the blade head; and the other end of the blade head is provided with a tip.

Optionally, the deicing blade further comprises a fixation beam;

the blade head comprises a plurality of blade heads, and the plurality of the blade heads are evenly arranged at the same side of the fixation beam along a thickness direction of the deicing wheel;

the connecting shank comprises two connecting shanks, and the two connecting shanks are both arranged at one side of the fixation beam away from the blade heads;

one side of the blade head away from the connecting shank is in a shape of an arc; and a chord length direction of the arc is perpendicular to a thickness direction of the deicing wheel.

Optionally, the deicing blade further comprises a scraping bar;

the scraping bar is arranged at one sides of the blade heads away from the fixation beam, and connects the plurality of blade heads.

Optionally, one side of the scraping bar away from the fixation beam is arc-shaped; and a chord length direction of the scraping bar is parallel to the chord length direction of the blade head, and the scraping bar and the blade head have the same radian.

Optionally, the deicing wheel is provided with a plurality of lightening holes; and the lightening holes are evenly arranged with the axis of the deicing wheel as a central axis.

Optionally, the connecting shank is provided with a returning device; and the returning device is connected with the connecting shank and the deicing wheel respectively, and is capable of making the connecting shank return from a position where the connecting shank reaches under action of external force to an original position.

An embodiment of the present invention provides a deicing vehicle, which comprises a vehicle body, a first adjustment mechanism, a second adjustment mechanism, and at least one deicing unit described above;

the at least one deicing unit is arranged in front of the vehicle body through the first adjustment mechanism and the second adjustment mechanism and is capable of performing a deicing operation when being driven by the vehicle body;

the first adjustment mechanism comprises a suspension bracket, a hydraulic cylinder, a hydraulic cylinder transverse arm, at least one first sub-adjustment unit, and a suspension boom, each first sub-adjustment unit comprises a main adjustment spring, a main adjustment screw rod, a main adjustment nut and a spring base;

one end of the hydraulic cylinder is rotatably connected with the deicing unit, and the other end of the hydraulic cylinder is rotatably connected with the hydraulic cylinder transverse arm;

the main adjustment screw rod has one end passing through the suspension bracket and is slidably connected with the suspension bracket;

one end of the main adjustment screw rod is fixedly connected with the hydraulic cylinder transverse arm, and the other end of the main adjustment screw rod is slidably connected with the spring base;

the main adjustment spring is sleeved outside the main adjustment screw rod, and one end of the main adjustment spring abuts against the spring base, and the other end of the main adjustment spring abuts against the suspension bracket; and the main adjustment nut is arranged at one end of the main adjustment screw rod and is arranged at one side of the spring base away from the main adjustment spring.

Optionally, a lifting spring is further sleeved outside the main adjustment screw rod; and one end of the lifting spring abuts against the suspension bracket, and the other end of the lifting spring abuts against the hydraulic cylinder transverse arm.

Optionally, the second adjustment mechanism comprises a cross shaft, fixation seats, a boom transverse arm, balance springs, and a pressure transmission adjusting assembly;

two opposite ends of the cross shaft are provided with the fixation seats respectively, and the other two ends of the cross shaft are rotatably connected with middle portions of two suspension booms respectively;

one end of each of the suspension booms is rotatably connected with the suspension bracket, and the other end of each of the suspension boom is connected with one end of the boom transverse arm;

the pressure transmission adjusting assembly is arranged at one side of the boom transverse arm close to the main frame;

one end of each of the balance spring is fixedly arranged on the main frame, and the other end of each of the balance spring is arranged opposite to a respective end of the boom transverse arm;

the fixation seats are fixedly arranged on the main frame;

one side of the cross shaft away from the main frame is rotatably connected with one end of the hydraulic cylinder;

the boom transverse arm is provided thereon with limit adjusting bolts;

the limit adjusting bolts are each arranged opposite to the respective balance spring.

Optionally, the pressure transmission adjusting assembly comprises an adjusting plate and an adjusting block;

the adjusting block is semicircular;

the adjusting block is fixedly arranged on the main frame;

the adjusting block has an arc surface arranged at one side close to the boom transverse arm;

the adjusting plate is an arc-shaped plate;

one side of the adjusting plate is fixedly arranged on the boom transverse arm, and the other side of the adjusting plate abuts against the arc surface of the adjusting block.

An embodiment of the present invention provides a deicing method using the deicing vehicle described above, the method comprising:

controlling the vehicle body to make the deicing unit close to ground;

controlling the hydraulic cylinder to make a hydraulic rod of the hydraulic cylinder extend out from a top dead center, such that the positioning wheel is in contact with the ground, and the deicing blades are not in contact with the ground;

controlling the hydraulic cylinder to make the hydraulic rod of the hydraulic cylinder continue to extend out, such that the positioning wheel adjustment spring is gradually compressed, and the deicing blades are close to the ground; and controlling the hydraulic cylinder to make the hydraulic rod of the hydraulic cylinder continue to extend out, such that the overall weight of the deicing unit is completely borne by the positioning wheel and the suspension booms.

Optionally, the method further comprises:

controlling the hydraulic cylinder to make the hydraulic rod of the hydraulic cylinder retracted back to the top dead center, so that the positioning wheel is suspended; and controlling the vehicle body to switch the deicing unit to another site.

Compared with the prior art, the embodiments of the present invention have the following beneficial effects:

with the adjustment mechanism for a deicing unit provided in the present invention, the deicing unit can operate in the case of a road longitudinal slope or transverse slope, or situations with different ice thicknesses, ice hardness and road qualities, thereby improving the adaptability and smoothness thereof, and ensuring the safety of the road surface and the device itself.

BRIEF DESCRIPTION OF DRAWINGS

For illustrating technical solutions of embodiments of the present invention more clearly, drawings required for the embodiments will be introduced briefly below. It is to be understood that the drawings below are merely illustrative of some embodiments of the present invention, and therefore should not to be considered as limiting the scope of the invention. It would be understood by those skilled in the art that other relevant drawings could also be obtained from these drawings without any inventive efforts.

Figure 1:
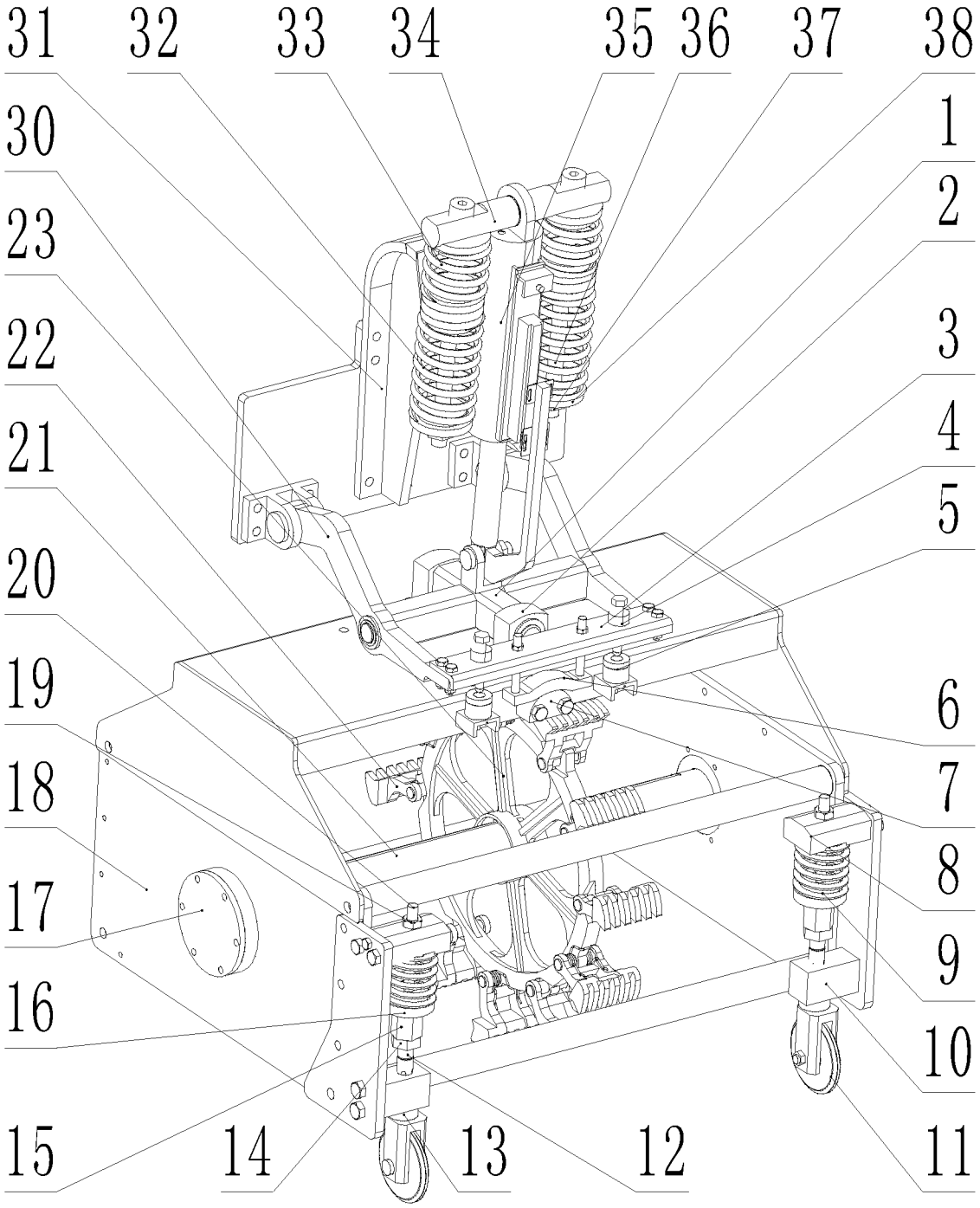
FIG. 1 is a schematic structural view of a deicing unit provided in the present invention.
Figure 2:
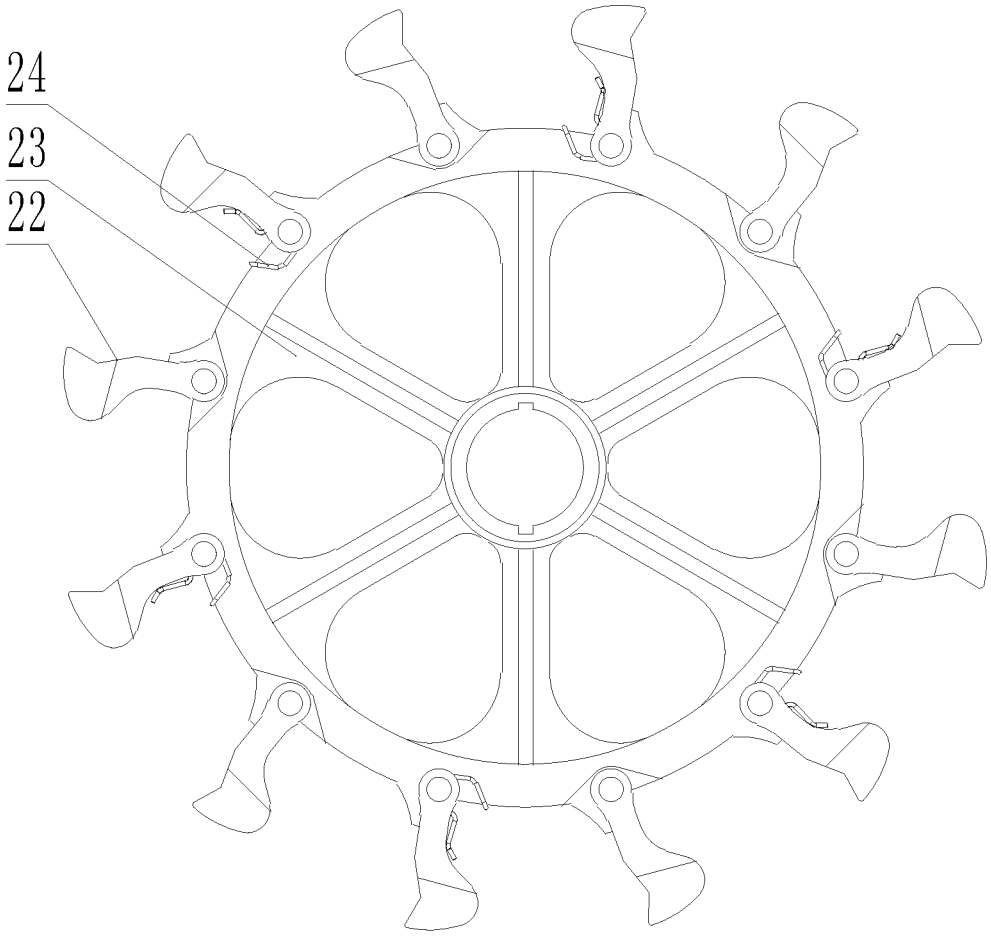
FIG. 2 is a schematic structural diagram of a deicing wheel provided in the present invention.
Figure 3:
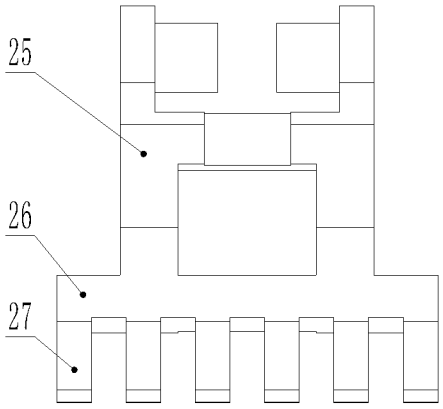
FIG. 3 is a schematic structural view of a deicing blade provided in the present invention.

Reference numerals: 1—cross shaft; 2—fixation seat; 3—boom transverse arm; 4—limit adjusting bolt; 5—balance spring; 6—adjusting plate; 7—adjusting block; 8—upper end cover; 9—positioning wheel adjustment spring; 10—base; 11—positioning wheel; 12—guide rod; 13—positioning wheel adjusting spacer; 14—jam nut; 15—guide rod adjusting nut; 16—lower end cover; 17—driving motor; 18—main frame; 19—pressure adjusting nut; 20—screw rod; 21—driving spindle; 22—deicing blade; 23—deicing wheel; 24—torsion spring; 25—connecting shank; 26—fixation beam; 27—blade head; 28—vehicle body; 29—deicing unit; 30—suspension boom; 31—suspension bracket; 32—main adjustment spring; 33—lifting spring; 34—hydraulic cylinder transverse arm; 35—hydraulic cylinder; 36—main adjustment screw rod; 37—main adjustment nut; 38—spring base; 39—scraping bar; 40—lightening hole.

DETAILED DESCRIPTION OF EMBODIMENTS

The technical solutions of the present invention will be described below clearly and completely with reference to the drawings. It is apparent that the embodiments to be described are some, but not all of the embodiments of the present invention. All the other embodiments obtained by those skilled in the art in light of the embodiments of the present invention without inventive efforts would fall within the scope of the present invention as claimed.

In the description of the present invention, it should be stated that orientation or positional relations indicated by the terms such as "center", "up", "down", "left", "right", "vertical", "horizontal", "inside", and "outside" are based on the orientation or positional relations as shown in the drawings, and these terms are intended only to facilitate the description of the present invention and simplify the description, but not to indicate or imply that the referred devices or elements must be in a particular orientation or constructed or operated in the particular orientation, and therefore should not be construed as limiting the present invention.

In addition, terms such as "first", "second", and "third" are used only for the purpose of description, and should not be understood as indicating or implying to have importance in relativity.

In the description of the present invention, it should be stated that unless otherwise expressly specified or defined, terms "mounted", "coupled", and "connected" should be understood broadly. For example, connection may be fixed connection or detachable connection or integral connection, may be mechanical connection or electric connection, or may be direct coupling or indirect coupling via an intermediate medium or internal communication between two elements. The specific meanings of the above-mentioned terms in the present invention could be understood by those skilled in the art according to specific situations.

As shown in FIG. 1, an embodiment of the present invention provides an adjustment mechanism for a deicing unit 29, comprising at least one sub-adjustment unit, each sub-adjustment unit comprises a positioning wheel 11, a guide rod 12, a screw rod 20, a positioning adjustment spring 9, an upper end cover 8, a lower end cover 16, and a pressure adjusting nut 19;

the positioning wheel 11 is rotatably arranged at one end of the guide rod 12, and an axis of the positioning wheel 11 is perpendicular to an axis of the guide rod 12;

the other end of the guide rod 12 is connected with one end of the screw rod 20;

the positioning wheel adjustment spring 9 is sleeved outside the screw rod 20, and one end of the positioning wheel adjustment spring 9 abuts against the upper end cover 8, and the other end of the positioning wheel adjustment spring 9 abuts against the lower end cover 16;

the upper end cover 8 is slidably arranged at one end of the screw rod 20 away from the guide rod 12;

the pressure adjusting nut 19 is arranged at one end of the screw rod 20 away from the guide rod 12 and at one side of the upper end cover 8 away from the guide rod 12, and the pressure adjusting nut 19 is configured to adjust the distance between the upper end cover 8 and the lower end cover 16, and can preload the positioning wheel adjustment spring 9; and the lower end cover 16 is fixedly arranged at one end of the screw rod 20 close to the guide rod.

It should be explained here that the other end of the guide rod 12 is connected with one end of the screw rod 20, and the connection here may be indirect connection, or may be direct connection, or may be detachable connection, fixed connection, integrated molding, or the like. In the present embodiment, the two parts are connected indirectly and achieve force transmission by abutting against each other.

In use, the upper end cover 8 is fixedly arranged on the deicing unit 29, and the distance between the upper end cover 8 and the lower end cover 16 is adjusted by the pressure adjusting nut 19 so as to adjust the initial pressure of the positioning wheel adjustment spring 9.

In general, the pressure adjusting nut 19 is configured to adjust the distance between the upper end cover 8 and the lower end cover 16, which may be the maximum distance, and may also be adjusted as appropriate.

In an optional implementation mode, the sub-adjustment unit of the adjustment mechanism for the deicing unit 29 further comprises a guide rod adjusting nut 15;

the guide rod adjusting nut 15 has one end connected with the guide rod 12 and the other end abutting against one side of the lower end cover 16 away from the positioning wheel adjustment spring 9, and the guide rod adjusting nut is configured to adjust the distance between the guide rod adjusting nut 15 and the lower end cover 16 so as to adjust the height of the guide rod 12.

During the adjustment, a jam nut 14 may also be arranged on the guide rod 12, and the stability of the guide rod adjusting nut 15 is ensured by the jam nut 14.

It should be noted that the adjustment of the positioning wheel 11 in the present embodiment is achieved by the guide rod adjusting nut 15, but it is not limited to such implementation mode, and it may also be implemented in other manners, for example, it is possible to provide internal threads or the like on the guide rod that cooperates with the screw rod 20 so as to adjust the height of the positioning wheel 11 by thread connection, in other words, it is only necessary that the height of the positioning wheel 11 can be adjusted to return to its original height after the initial pressure of the positioning wheel adjustment spring 9 is adjusted.

In an optional implementation mode, the sub-adjustment unit of the adjustment mechanism for the deicing unit 29 further comprises a base 10;

the base 10 is provided with a positioning hole; and the guide rod 12 is slidably connected with the base 10 through the positioning hole.

The adjustment mechanism further comprises the base 10, the base 10 is fixedly arranged on the deicing unit 29 and provided with a positioning hole through which the guide rod 12 passes, thereby defining a movement trajectory of the positioning wheel 11 in upward and downward directions.

In an optional implementation mode, the guide rod 12 is provided with a positioning wheel adjusting spacer 13; and the positioning wheel adjusting spacer 13 is arranged at one side of the base 10 close to the positioning wheel 11, and configured to adjust the distance between the positioning wheel 11 and the base 10 and at the same time serve as a measure to ensure a safe distance between a lower tangent point on an outer circle of the positioning wheel and a top end of the deicing blade.

According to the adjustment mechanism provided in the present embodiment, some functions and principles thereof are as follows.

During the execution of deicing operations, the adjustment mechanism for the deicing unit must meet the following requirements:

1. A preset pressure is given to the deicing unit, and this pressure is adjustable so that reaction force generated when the deicing blades strike the frozen ice will not cause the deicing unit to jump, so as to achieve safe and smooth deicing operations.

2. The effective distance between the deicing blade and the road surface (namely, the distance between an edge portion of the deicing blade revolved to the lowermost position and the road surface) can be regulated depending on different requirements of sites to be deiced; and it is ensured that the related requirements under the first condition can be met within the adjustable range.

3. There is a measure to protect the road surface.

In an embodiment of the invention, the presetting and regulation of the pressure given to the deicing unit are achieved in such a manner that the guide rod adjusting nut is adjusted, that is, the distance between a top end of the nut and the positioning wheel is lengthened, which is based on the requirement that when the top end of the nut is in contact with a lower plane of the lower end cover, the lower tangent point on the outer circle of the positioning wheel and the edge portion of the deicing blade revolved to the lowermost position are located at relative positions in a horizontal plane such that the lower tangent point is lower than the edge portion of the deicing blade. Namely, a distance is set between the edge portion and the lower tangent point.

The length of this distance depends on the confirmation of a deicing operation adjustment range during the design of the product. In the embodiment of the present invention, the deicing operation adjustment range is confirmed to be 10 mm.

The distance between the edge portion and the lower tangent point should be greater than 10 mm, and is set in the embodiment of the present invention to be 20 mm (the distance is not limited to 20 mm as long as it is greater than 10 mm, depending on the pressure applied to the deicing unit).

A hydraulic rod of a hydraulic cylinder is controlled to be extended out so that the deicing unit moves downwards, and when the positioning wheel is in contact with the road surface, the edge portion of the deicing blade revolved to the lowermost position in the present embodiment is still 20 mm away from the road surface.

At this moment, the force transmission path has changed.

When the positioning wheel is not in contact with the road surface, the deicing unit is in a lifted state. The weight of the deicing unit acts on an upper plane of a suspension bracket through the hydraulic cylinder, a hydraulic cylinder transverse arm, and a lifting spring. The upper plane of the suspension bracket bears the force (the suspension bracket can be regarded as a base point at which the force acts).

When the positioning wheel is in contact with the road surface, the force is changed to be exerted on a lower plane of the suspension bracket, and the deicing unit is in a state where it is pushed downward.

At this time, the force is transmitted along a path from the lower plane of the suspension bracket/a main adjustment spring compressed gradually/a main adjustment screw rod/the hydraulic cylinder transverse arm/a pressure transmission assembly to a main frame.

The hydraulic rod is controlled to continue to extend out, but at this time the continuous downward movement of the deicing unit is subjected to a resistance.

The resistance comes from the positioning wheel which has been in contact with the road surface, the positioning wheel pushes the guide rod thereof to travel upwards through a hole in the base, and the guide rod is connected to the guide rod adjusting nut; the top of the adjusting nut abuts against the lower end cover; the lower end cover abuts against the upper end cover through the positioning wheel adjustment spring; and the upper end cover is fixedly connected with the main frame.

The pressure generated by the continued extension of the hydraulic rod and the reaction force generated by the positioning wheel which has been in contact with the road surface converge at the upper end of the positioning wheel adjustment spring and at the lower plane of the upper end cover (the upper end cover is fixedly connected with the main frame).

The stiffness of the main adjustment spring is set to be greater than the stiffness of the positioning wheel adjustment spring, the hydraulic rod is controlled to continue to extend out, and after having overcome the resistance generated by the positioning wheel adjustment spring, the deicing unit continues to move downward until it enters the set deicing operation adjustment range (namely, the edge portion of the deicing blade revolved to the lowermost position is 10 mm away from the road surface).

It can be seen from the above that the presetting of the pressure has been achieved before the deicing unit is brought into the deicing state.

According to the actual demands of the site to be deiced, the extension and retraction of the hydraulic cylinder are finely controlled so that the deicing unit is reasonably controlled within the deicing operation adjustment range. The requirements in Items 1 and 2 in the design are achieved.

The regulation of the preset pressure is achieved by means of the pressure adjusting nut together with the guide rod adjusting nut. The pressure adjusting nut is tightened so that the positioning wheel adjustment spring is compressed; and the guide rod adjusting nut is loosened so that it is lengthened and followed by the positioning wheel adjustment spring, and then the preset pressure is increased, whereas the pressure is decreased by an opposite adjustment.

The protection of the road surface during the deicing operation is achieved by means of the positioning wheel adjusting spacer (the adjusting spacer can also be replaced with an adjusting nut). The thickness or thinness of the spacer is adjusted so that when the shoulder of the U-shaped structure of the guide rod is in complete contact with the adjusting spacer and the lower plane of the base, the distance between the edge portion of the deicing blade revolved to the lowermost position and the road surface is ensured to be approximated to and greater than 0. Namely, theoretically, the edge portion of the deicing blade will not be in contact with the road surface in any case.

An embodiment of the present invention further provides a deicing unit 29, as shown in FIGS. 1-5, which comprises a main frame 18, a driving spindle 21, a driving motor 17, a deicing wheel 23, a plurality of deicing blades 22, and the adjustment mechanism described above;

the driving motor 17 is arranged at one end of the driving spindle 21 and fixedly arranged on the main frame 18;

the deicing wheel 23 is coaxially and fixedly arranged on the driving spindle 21;

the plurality of deicing blades 22 are evenly arranged in a circumferential direction of the deicing wheel 23 with an axis of the deicing wheel 23 as a central axis;

the upper end cover 8 is fixedly arranged on the main frame 18; and an axis of the positioning wheel 11 is parallel to an axis of the driving spindle 21.

In the present embodiment, a plurality of deicing wheels 23 are used to be connected in series by the driving spindle 21, thereby increasing the width of the removed ice and improving the deicing efficiency.

In use, the height of the deicing wheel 23 is adjusted so that a certain gap is formed between the deicing blade 22 and the road surface when the deicing blade is revolved around the deicing wheel 23, such that when the deicing unit operates in the case of a road longitudinal slope or transverse slope, or situations with different ice thicknesses, ice hardness and road qualities, the adaptability and smoothness thereof are improved, and the safety of the road surface and the device itself is ensured.

In an optional implementation mode, the deicing blade 22 comprises a connecting shank 25 and a blade head 27;

one end of the connecting shank 25 is rotatably connected with the deicing wheel 23;

the other end of the connecting shank 25 is fixedly connected with a side portion at one end of the blade head 27;

the other end of the blade head 27 is provided with a tip.

In the present embodiment, the tip (or edge portion) of the deicing blade revolved to the lowermost position coincides with a circle-central vertical line of the deicing wheel, or is located behind the vertical line (It should be biased to the 5 o'clock direction if the deicing wheel rotates clockwise. See FIG. 2).

The blade head 27 of the deicing blade 22 is connected with the deicing wheel 23 through the connecting shank 25, the connecting shank 25 is rotatably connected with the deicing wheel 23, and when encountering an obstacle, the connecting shank 25 can be deflected so as to avoid the obstacle and avoid damage to the deicing blade 22 caused by the obstacle.

In the present embodiment, a plurality of blade heads 27 are evenly arranged at the same side of a fixation beam 26 in the thickness direction of the deicing wheel 23; and there are two connecting shanks 25, both of which are arranged at one side of the fixation beam 26 away from the blade heads 27.

One side of the blade head 27 away from the connecting shank 25 is in a shape of an arc; and the chord length direction of the arc is perpendicular to the thickness direction of the deicing wheel 23.

In the present embodiment, the radian of the blade head is slightly smaller than the radian of an outer circle of a combination of the deicing blades and the deicing wheel. A jump will occur in the deicing operation if the radian of the blade head is too large; and the deicing effect will be affected if the radian is too small.

The plurality of blade heads 27 are arranged together in parallel by the fixation beam 26, which can effectively increase the range of operation of the blade heads 27, and thereby can effectively improve the working efficiency of the blade heads 27.

Two connecting shanks 25 are fixedly arranged at the other side of the fixation beam 26, and the two connecting shanks 25 are arranged at two sides of the deicing wheel 23 respectively, to ensure the balance and stability of the connection.

It should be noted that the number of the connecting shanks 25 may be two, but is not limited to two, and may also be four, six, or the like. It is optional that there are even number of the connecting shanks 25 which are symmetrically arranged at two sides of the deicing wheel 23.

Figure 4:
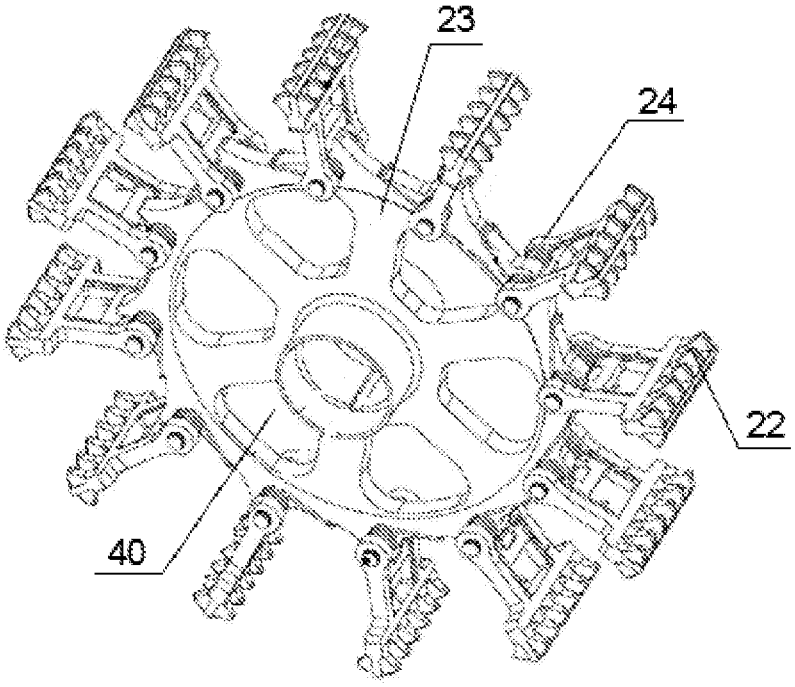
FIG. 4 is a schematic structural view of another deicing wheel provided in the present invention.
Figure 5:
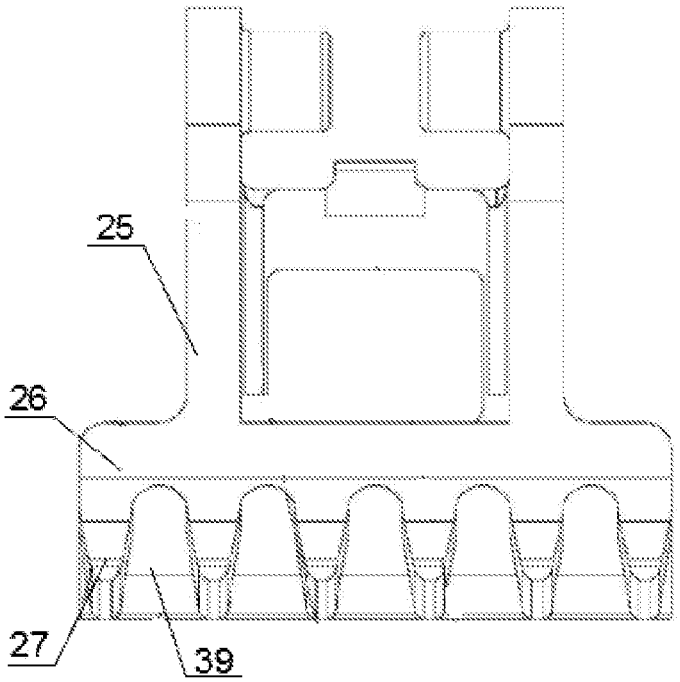
FIG. 5 is a schematic structural view of another deicing blade provided in the present invention.
Figure 6:
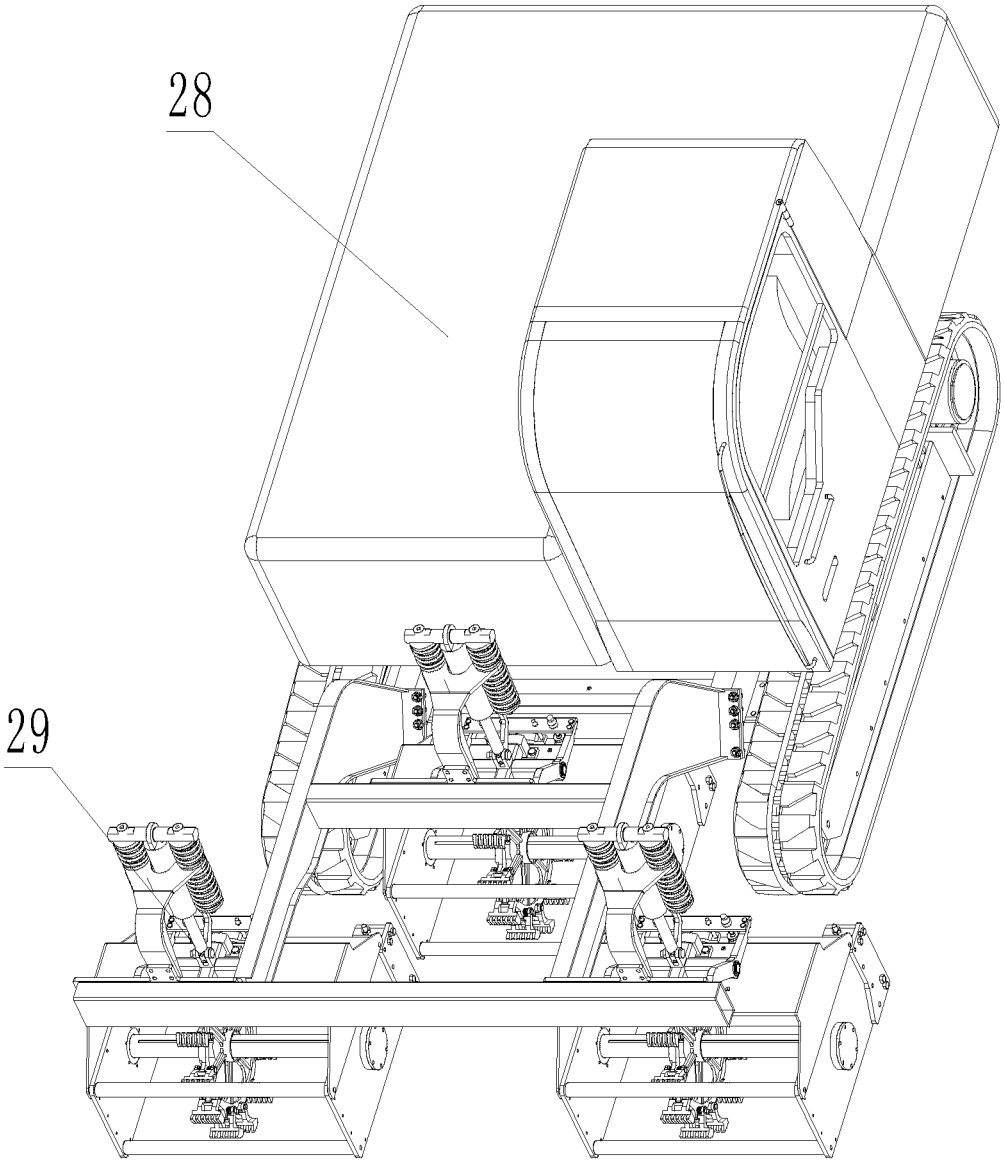
FIG. 6 is a schematic structural view of a deicing vehicle provided in the present invention.

With reference to FIGS. 4 and 5, the deicing blade 22 further comprises a scraping bar 39;

the scraping bar 39 is arranged at one side of the blade head 27 away from the fixation beam 26, and connects the plurality of blade heads 27;

one side of the scraping bar 39 away from the fixation beam 26 is arc-shaped;

the chord length direction of the scraping bar 39 is parallel to the chord length direction of the blade head 27, and they have the same radian;

the deicing wheel 23 is provided with a plurality of lightening holes 40;

the lightening holes 40 are evenly arranged with the axis of the deicing wheel 23 as a central axis.

In an optional implementation mode, the connecting shank 25 is provided with a returning device;

the returning device is connected with the connecting shank 25 and the deicing wheel 23 respectively, and is capable of making the connecting shank 25 return from a position where the connecting shank reaches under action of external force to an original position.

Therefore, in the present invention, the deicing blade 22 is rotatably connected with the deicing wheel 23, and thus when the deicing blade 22 encounters an obstacle, the deicing blade is hindered by the obstacle, and thus the deicing blade is revolved in a direction towards the center of the deicing wheel 23, that is, the blade head 27 does not directly collide with the obstacle, avoiding damage to the blade head 27 by the obstacle. However, if the deicing blade 22 is not returned to the original position after passing over the obstacle, the subsequent deicing will become insufficient, thereby affecting the effect of shoveling ice.

The connecting shank 25 is provided with the returning device, and the returning device is connected with the connecting shank 25 and the deicing wheel 23 respectively, such that when the connecting shank 25 is hindered by an obstacle and then rotated, the returning device can give returning force to the connecting shank 25 after the deicing wheel 23 has passed over the obstacle, so that the connecting shank 25 is returned to the original position and the deicing blades 22 can continue normal operation.

In the present embodiment, a spring of the returning device is arranged as a torsion spring 24, an engagement portion for the torsion spring 24 is arranged between the two connecting shanks 25, a groove for the torsion spring 24 is arranged at the engagement portion, and one end of the torsion spring 24 is arranged in the groove for the torsion spring 24, so as to ensure that the end of the torsion spring 24 which abuts against the engagement portion does not affect the returning function of the deicing unit 22 due to its displacement. The deicing wheel 23 may also be correspondingly provided with the groove for the torsion spring 24, or it is also possible that the other end of the torsion spring 24, after bent, abuts against the periphery of the deicing wheel 23.

In other words, it is only necessary that both ends of the torsion spring 24 respectively abut against the connecting shank 25 and the deicing wheel 23 so that the connecting shank 25 can be driven to be returned to the original position.

Since the torsion spring 24 abuts against each of the connecting shank 25 and the deicing wheel 23, the direction of the returning of the deicing blade 22 achieved by the torsion spring is limited, in other words, the torsion spring 24 in this case produces a force in only one direction.

It should be noted that although the returning device may be arranged as the torsion spring 24, it is not limited to the torsion spring 24, and may also be of any other structure, for example, two sides of the connecting shank 25 may be each provided with one tension spring or one pressure spring, in other words, as long as it can achieve the returning function of the connecting shank 25.

An embodiment of the present invention further provides a deicing vehicle, as shown in FIGS. 1-6, which comprises a vehicle body 28, a first adjustment mechanism, a second adjustment mechanism, and the deicing unit 29 described above;

the deicing unit 29 is arranged in front of the vehicle body 28 by the first adjustment mechanism and the second adjustment mechanism and is capable of performing a deicing operation when driven by the vehicle body 28;

the first adjustment mechanism comprises a suspension bracket 31, a hydraulic cylinder 35, a hydraulic cylinder transverse arm 34, a first sub-adjustment unit, and a suspension boom 30, the first sub-adjustment unit comprises a main adjustment spring 32, a main adjustment screw rod 36, a main adjustment nut 37 and a spring base 38;

the hydraulic cylinder 35 has one end rotatably connected with the deicing unit 29 and the other end rotatably connected with the hydraulic cylinder transverse arm 34;

the main adjustment screw rod 36 has one end passing through the suspension bracket 31 and is slidably connected with the suspension bracket 31;

the main adjustment screw rod 36 has one end fixedly connected with the hydraulic cylinder transverse arm 34 and the other end slidably connected with the spring base 38;

the main adjustment spring 32 is sleeved outside the main adjustment screw rod 36, and the main adjustment spring 32 has one end abutting against the spring base 38 and the other end abutting against the suspension bracket; and the main adjustment nut 37 is arranged at one end of the main adjustment screw rod 36 and is arranged at one side of the spring base 38 away from the main adjustment spring 32.

In the present embodiment, after the first adjustment mechanism is mounted, the deicing unit 29 can be automatically regulated in the height direction so as to adapt to more complicated environment.

In an optional implementation mode, a lifting spring 33 is further sleeved outside the main adjustment screw rod 36;

the lifting spring 33 has one end abutting against the suspension bracket and the other end abutting against the hydraulic cylinder transverse arm 34.

The function of the lifting spring is to reduce the impact of the deicing unit on the deicing vehicle due to road quality problems when the operation of the deicing vehicle is switched to another site.

In an optional implementation mode, the second adjustment mechanism comprises a cross shaft 1, fixation seats 2, a boom transverse arm 3, a balance springs 5, and a pressure transmission adjusting assembly;

the cross shaft 1 has two opposite ends provided with the fixation seats 2 respectively, and the other two ends rotatably connected with middle portions of two suspension booms 30 respectively;

the suspension boom 30 has one end rotatably connected with the suspension bracket 31, and the other end connected with one end of the boom transverse arm 3;

the pressure transmission adjusting assembly is arranged at one side of the boom transverse arm 3 close to the main frame 18;

the balance springs 5 has one ends fixedly arranged on the main frame 18 and the other ends arranged opposite to two ends of the boom transverse arm 3 respectively;

the fixation seats 2 are fixedly arranged on the main frame 18;

one side of the cross shaft 1 away from the main frame 18 is rotatably connected with one end of the hydraulic cylinder 35;

the boom transverse arm 30 is provided with limit adjusting bolts 4;

the limit adjusting bolts 4 are each arranged opposite to the respective balance spring 5.

In the present embodiment, the other end of the suspension boom 30 is fixedly connected with the boom transverse arm 3, and in other embodiments, the other end of the suspension boom may be rotatably connected with, or has a partial structure integrally formed with the boom transverse arm 3.

In the present embodiment, after the second adjustment mechanism is mounted, the deicing unit 29 can be automatically regulated in leftward, rightward, frontward, and backward directions to adapt to a more complicated environment.

The opposite two ends of the cross shaft 1 are rotatably connected with two suspension booms, the other two opposite ends of the cross shaft are rotatably connected with the fixation seats 2, and the middle cross portion of the cross shaft 1 is rotatably connected with one end of the hydraulic cylinder.

Such arrangement enables a rotation of the deicing unit 29 in any of the frontward, backward, leftward, and rightward directions by several rotatable connections such as the rotatable connections of two ends of the suspension boom, the rotatable connection between the first adjustment mechanism and the cross shaft 1, and the rotatable connection between the cross shaft 1 and the fixation seats 2, so that the deicing unit 29 can operate normally in any terrain.

The balance springs 5 have one ends fixedly arranged on the main frame 18 and the other ends arranged opposite to two ends of the boom transverse arm 3 respectively; the boom transverse arm 3 is arranged fixedly in the horizontal direction, and thus the boom transverse arm 3 does not shake during the deicing operation, and while the deicing unit 29 is shaking, since the balance springs 5 on the main frame 18 are arranged corresponding to two ends of the boom transverse arm 3 respectively, the balance springs 5 will abut against the boom transverse arm 3, thereby limiting the range of shaking thereof, and avoiding the excessive shaking of the deicing unit 29.

In the present embodiment, the balance spring 5 is a compression spring which abuts against the deicing unit 29.

In order to adapt to a turning transverse slope and a drainage transverse slope in the operation site, a landform transverse tracing mechanism is designed to control vibration or jump resulting from inclination so as to improve the deicing effect. The landform transverse tracing mechanism consists of the cross shaft 1, a balance spring and a limit block, and the deicing unit 29 can swing up and down transversely on the cross shaft 1. The balance spring limits its free swing; and the limit block defines the swing amplitude.

In the present embodiment, the boom transverse arm 3 is unmovable, and the limit adjusting bolt 4 is rotated to move downwards, so that the lower end of the limit adjusting bolt 4 is close to the balance spring 5 to reduce the gap between the limit adjusting bolt 4 and the balance spring 5, thereby reducing the inclination range.

The inclination range can be increased by only reversely rotating the limit adjusting bolt 4 to increase the distance between the limit adjusting bolt and the balance spring 5.

In an optional implementation mode, the pressure transmission adjusting assembly comprises an adjusting plate 6 and an adjusting block 7;

the adjusting block 7 is semicircular;

the adjusting block 7 is fixedly arranged on the main frame 18;

the adjusting block 7 has an arc surface arranged at one side close to the boom transverse arm;

the adjusting plate 6 is an arc-shaped plate;

the adjusting plate 6 has one side fixedly arranged on the boom transverse arm and the other side abutting against the arc surface of the adjusting block 7; and the transmission of force between the vehicle body 28 and the deicing unit 29 can be ensured by the pressure transmission adjusting assembly.

It should be stated here that the adjustment mechanism in the present embodiment may selectively comprise the related structures in the deicing vehicle described above.

In other words, these structures can be selectively mounted in the adjustment mechanism, and enable independent use, production, sales and so on.

During the deicing operation, in order to effectively protect the road surface and ensure the deicing effect, the deicing unit needs a reliable supporting foundation to enable an establishment of an adjustable and maintainable geometric relationship between the deicing blades of the deicing unit and the road surface.

After the deicing unit crushes the frozen ice, a road surface with a width greater than that of a rubber track is cleared by the scraping plate, and the track runs on the cleared road surface, and in this case, a tracked chassis, a mounting platform, the adjustment mechanism(s), the deicing unit(s) and the positioning wheel(s) interact with one another so as to substantially establish a controllable geometric relationship. This provides conditions for adjusting the height of the deicing blade from the road surface and adjusting the pressure applied to the deicing unit.

The vehicle body in the present embodiment consists of a rubber track and a mounting platform. The rubber track makes it meet the requirements related to road running of engineering vehicles, and increases the attachment to the road surface. The mounting platform is a platform where the mechanisms such as a power unit and a control unit are assembled, in addition to serving as a mechanism for connecting and assembling three deicing units.

An embodiment of the present invention further provides a deicing method using the deicing vehicle described above, the method comprising:

controlling the vehicle body to make the deicing unit close to ground;

controlling the hydraulic cylinder to make a hydraulic rod of the hydraulic cylinder extend out from a top dead center, such that the positioning wheel is in contact with the ground, and the deicing blades are not in contact with the ground;

controlling the hydraulic cylinder to make the hydraulic rod of the hydraulic cylinder continue to extend out, such that the positioning wheel adjustment spring is gradually compressed, and the deicing blades are close to the ground; and controlling the hydraulic cylinder to make the hydraulic rod of the hydraulic cylinder continue to extend out, such that the overall weight of the deicing unit is completely borne by the positioning wheel and the suspension booms.

The force transmission path in this process is as follows:

with the lower end surface of the suspension bracket being used as a base point at which a pressure is applied, the pressure is transmitted via the main adjustment spring(s)→the base(s) of the main adjustment spring(s)→the screw rod(s) of the main adjustment spring(s)→the nut(s)→the hydraulic cylinder transverse arm→the hydraulic cylinder→the hydraulic rod→the cross shaft→the suspension boom(s)→the suspension boom transverse arm→the pressure transmission assembly→the main frame→the upper end cover(s)→the positioning wheel adjustment spring(s)→the guide rod(s)→the tangent point(s) on the outer circle(s) of the positioning wheel(s) to the road surface. At this moment, the direction of the transmission of the force is changed. The base point at which the suspension bracket bears the force is changed from the upper end surface to the lower end surface, and the deicing unit is changed from a suspended state to a pressed state.

Assuming that the tip of the blade head is 20 mm away from the ground when the deicing unit has just been pressed, it is shown that the deicing unit has started to be brought into a normal working state when the tip is 10 mm away from the ground.

The distance is assumed and can be regulated in specific implementation.

During the regulation, the hydraulic cylinder exerts force on the center of the main frame; the positioning wheel(s) is/are arranged behind the main frame; and the suspension boom(s) is/are supported between the center of the main frame and the suspension bracket. The interaction among the three parts enables almost vertical upward and downward movements of the deicing unit during the regulation of the height of the deicing blades from the road surface, and is an ideal technical measure.

The method further comprises:

controlling the hydraulic cylinder to make the hydraulic rod of the hydraulic cylinder retracted back to the top dead center, so that the positioning wheel is suspended; and controlling the vehicle body to switch the deicing unit to another site.

In general, a limiter structure is also arranged so that when the hydraulic rod is retracted, the deicing unit is lifted to a set height and locked by the limiter, avoiding its sliding.

A reasonable deicing mode, such as strong deicing, ordinary deicing, or mild deicing, is selected according to the situation of the site to be deiced. In the present embodiment, the strong deicing mode indicates that the edge portion of the deicing blade revolved to the lowermost position is at a distance of 1 to 2 mm from the road surface; the ordinary deicing mode indicates that the edge portion of the deicing blade revolved to the lowermost position is at a distance of 5 to 6 mm; and the mild deicing mode indicates that the edge portion of the deicing blade revolved to the lowermost position is at a distance of 8 to 10 mm.

When, for example, the road is flat and has high ice hardness, the strong deicing mode is employed to improve the deicing effect; when, for example, the road has low quality and low ice hardness, the mild deicing mode is employed to improve the deicing efficiency; and the ordinary deicing mode may be employed in other cases.

After the deicing mode is determined, the locking of the deicing unit when it is switched to another site is released, and the hydraulic cylinder is controlled so that the deicing unit is moved downward until it reaches the selected working state.

It should be stated that, in a practical operation, it is only needed to press a button for the selected mode, and a control unit composed of a controller and a sensor will automatically accomplish the selected work target.

When to be switched to another site after the deicing operation is finished, the hydraulic cylinder is controlled so that the deicing unit is moved upward and the deicing unit is lifted to the set height and locked.

The related functions of the positioning wheel provided in the present embodiment are introduced as follows:

Function 1:

The positioning wheel limits the height of the deicing blade from the road surface to ensure that the road surface is not damaged during the deicing operation, which is achieved by adjusting the positioning wheel adjusting spacer (what is arranged on the guide rod is actually an adjusting nut). The adjusting spacer has the lower plane abutting against the guide rod at a position close to the positioning wheel, and the upper plane abutting against the lower plane of the base. The base is fixedly connected with the frame of the deicing unit; the deicing blade is connected to the frame via the deicing wheel and the driving spindle; therefore, the edge portion of the deicing blade when it is revolved to the road surface is at a fixed distance from the lower plane of the base. The lower tangent point on the outer circle of the positioning wheel abuts against the road surface, and the adjustment of the thickness or thinness of the adjusting spacer is an adjustment of the height of the edge portion of the deicing blade from the road surface.

Function 2:

The adjustment of the pressure on the deicing unit: the pressure on the deicing unit is caused by the extension of the hydraulic rod. The force applied by one end of the hydraulic cylinder is transmitted to the lower plane of the suspension bracket via the hydraulic cylinder transverse arm, the main adjustment screw rod, the spring base, and the main adjustment spring; the force applied by the other end of the hydraulic cylinder is transmitted to the upper end cover of the positioning wheel structure via the pressure transmission assembly and the frame; and the force transmitted to the upper end cover is transmitted to the road surface via the positioning wheel adjustment spring, the lower end cover, the guide rod adjusting nut, the guide rod, and the positioning wheel. The pressure is transmitted along the path from the lower plane of the suspension bracket to the positioning wheel and then to the road surface.

The presetting of the pressure: when the positioning wheel is in contact with the road surface, and the lower plane of the lower end cover is just in contact with the upper end of the guide rod adjusting nut, the edge portion of the deicing blade revolved to the road surface is not in contact with the road surface. The hydraulic rod continues to extend out, so that the deicing unit continues to move downward as a whole, and the positioning wheel that has been in contact with the road surface forces the guide rod adjusting nut at the top of the guide rod thereof to move upward only after having overcome the resistance from the positioning wheel adjustment spring. Namely, a pressure is preset for the deicing unit when the edge portion of the deicing blade is not in contact with the road surface. The hydraulic rod continues to extend out to reach a state required by the deicing operation.

The regulation of the pressure is achieved by adjusting the length of the guide rod adjusting nut and presetting of the stiffness of the positioning wheel adjustment spring. The guide rod travels through the hole in the base; and the screw rod travels through the hole in the upper end cover. The upper end of the guide rod adjusting nut abuts against the lower plane of the lower end cover.

In the present embodiment, the related descriptions of the adjustment mechanism, the deicing unit, the deicing vehicle and so on have been presented previously.

The deicing vehicle can also have the following function: a self-holding ability of the track running on the iced road surface, wherein the track runs on the road surface from which the frozen ice has been removed, and a reliable base point is provided for the working of the adjustment mechanism by utilizing the characteristic that the track is parallel to the road surface. Finally, it should be stated that the foregoing various embodiments are merely intended to illustrate, but not to limit, the technical solutions of the present invention. Although the present invention has been described in detail with reference to the foregoing various embodiments, it should be understood by those skilled in the art that the technical solutions described in the foregoing various embodiments may still be modified, or some or all of the technical solutions may be replaced by equivalents; and these modifications or replacements will not cause the essence of the corresponding technical solutions to depart from the scope of the technical solutions of the various embodiments of the present invention.

INDUSTRIAL APPLICABILITY

In summary, the present invention provides an adjustment mechanism which can be adapted to most of deicing units, and which, in use, can avoid damage to the road surface while effectively achieving deicing, so as to greatly reduce the cost of maintenance of the road surface.

The invention claimed is:

1. An adjustment mechanism for a deicing unit, comprising at least one sub-adjustment unit, wherein each sub-adjustment unit comprises a positioning wheel, a guide rod, a screw rod, a positioning wheel adjustment spring, an upper end cover, a lower end cover, and a pressure adjusting nut, wherein the positioning wheel is rotatably arranged at one end of the guide rod, with an axis of the positioning wheel is perpendicular to an axis of the guide rod;

other end of the guide rod is connected with one end of the screw rod;

the positioning wheel adjustment spring is sleeved outside the screw rod, and one end of the positioning wheel adjustment spring abuts against the upper end cover, and other end of the positioning wheel adjustment spring abuts against the lower end cover;

the upper end cover is slidably arranged at one end of the screw rod away from the guide rod;

the pressure adjusting nut is arranged at the one end of the screw rod away from the guide rod and arranged at one side of the upper end cover away from the guide rod, and the pressure adjusting nut is configured to adjust a maximum distance between the upper end cover and the lower end cover, and to be able to preload the positioning wheel adjustment spring; and the lower end cover is fixedly arranged at one end of the screw rod close to the guide rod, wherein the adjustment mechanism further comprises a main frame and a first adjustment mechanism;

wherein the first adjustment mechanism comprises a suspension bracket, a hydraulic cylinder, a hydraulic cylinder transverse arm, at least one first sub-adjustment unit and a suspension boom, each first sub-adjustment unit comprises a main adjustment spring, a main adjustment screw rod, a main adjustment nut and a spring base;

one end of the hydraulic cylinder is rotatably connected with the main frame, and other end of the hydraulic cylinder is rotatably connected with the hydraulic cylinder transverse arm;

the main adjustment screw rod has one end passing through the suspension bracket and is slidably connected with the suspension bracket;

one end of the main adjustment screw rod is fixedly connected with the hydraulic cylinder transverse arm, and other end of the main adjustment screw rod is slidably connected with the spring base;

the main adjustment spring is sleeved outside the main adjustment screw rod, and one end of the main adjustment spring abuts against the spring base, and other end of the main adjustment spring abuts against the suspension bracket; and the main adjustment nut is arranged at one end of the main adjustment screw rod and is arranged at one side of the spring base away from the main adjustment spring.

2. The adjustment mechanism for a deicing unit according to claim 1, wherein the sub-adjustment unit further comprises a guide rod adjusting nut, wherein one end of the guide rod adjusting nut is connected with the guide rod, and other end of the guide rod adjusting nut abuts against one side of the lower end cover away from the positioning wheel adjustment spring, and the guide rod adjusting nut is configured to adjust a distance between the guide rod adjusting nut and the lower end cover so as to adjust a height of the guide rod.

3. The adjustment mechanism for a deicing unit according to claim 1, wherein the sub-adjustment unit further comprises a base, wherein the base is provided with a positioning hole;

the guide rod is slidably connected with the base through the positioning hole.

4. The adjustment mechanism for a deicing unit according to claim 2, wherein the sub-adjustment unit further comprises a base, wherein the base is provided with a positioning hole;

the guide rod is slidably connected with the base through the positioning hole.

5. The adjustment mechanism for a deicing unit according to claim 2, further comprising a main frame and a first adjustment mechanism;

wherein the first adjustment mechanism comprises a suspension bracket, a hydraulic cylinder, a hydraulic cylinder transverse arm, at least one first sub-adjustment unit and a suspension boom, each first sub-adjustment unit comprises a main adjustment spring, a main adjustment screw rod, a main adjustment nut and a spring base;

one end of the hydraulic cylinder is rotatably connected with the main frame, and other end of the hydraulic cylinder is rotatably connected with the hydraulic cylinder transverse arm;

the main adjustment screw rod has one end passing through the suspension bracket and is slidably connected with the suspension bracket;

one end of the main adjustment screw rod is fixedly connected with the hydraulic cylinder transverse arm, and other end of the main adjustment screw rod is slidably connected with the spring base;

the main adjustment spring is sleeved outside the main adjustment screw rod, and one end of the main adjustment spring abuts against the spring base, and other end of the main adjustment spring abuts against the suspension bracket; and the main adjustment nut is arranged at one end of the main adjustment screw rod and is arranged at one side of the spring base away from the main adjustment spring.

6. The adjustment mechanism for a deicing unit according to claim 3, further comprising a main frame and a first adjustment mechanism;

wherein the first adjustment mechanism comprises a suspension bracket, a hydraulic cylinder, a hydraulic cylinder transverse arm, at least one first sub-adjustment unit and a suspension boom, each first sub-adjustment unit comprises a main adjustment spring, a main adjustment screw rod, a main adjustment nut and a spring base;

one end of the hydraulic cylinder is rotatably connected with the main frame, and other end of the hydraulic cylinder is rotatably connected with the hydraulic cylinder transverse arm;

the main adjustment screw rod has one end passing through the suspension bracket and is slidably connected with the suspension bracket;

one end of the main adjustment screw rod is fixedly connected with the hydraulic cylinder transverse arm, and other end of the main adjustment screw rod is slidably connected with the spring base;

the main adjustment spring is sleeved outside the main adjustment screw rod, and one end of the main adjustment spring abuts against the spring base, and other end of the main adjustment spring abuts against the suspension bracket; and the main adjustment nut is arranged at one end of the main adjustment screw rod and is arranged at one side of the spring base away from the main adjustment spring.

7. The adjustment mechanism for a deicing unit according to claim 4, further comprising a main frame and a first adjustment mechanism;

wherein the first adjustment mechanism comprises a suspension bracket, a hydraulic cylinder, a hydraulic cylinder transverse arm, at least one first sub-adjustment unit and a suspension boom, each first sub-adjustment unit comprises a main adjustment spring, a main adjustment screw rod, a main adjustment nut and a spring base;

one end of the hydraulic cylinder is rotatably connected with the main frame, and other end of the hydraulic cylinder is rotatably connected with the hydraulic cylinder transverse arm;

the main adjustment screw rod has one end passing through the suspension bracket and is slidably connected with the suspension bracket;

one end of the main adjustment screw rod is fixedly connected with the hydraulic cylinder transverse arm, and other end of the main adjustment screw rod is slidably connected with the spring base;

the main adjustment spring is sleeved outside the main adjustment screw rod, and one end of the main adjustment spring abuts against the spring base, and other end of the main adjustment spring abuts against the suspension bracket; and the main adjustment nut is arranged at one end of the main adjustment screw rod and is arranged at one side of the spring base away from the main adjustment spring.

8. The adjustment mechanism for a deicing unit according to claim 1, wherein a lifting spring is further sleeved outside the main adjustment screw rod; and one end of the lifting spring abuts against the suspension bracket, and other end of the lifting spring abuts against the hydraulic cylinder transverse arm.

9. The adjustment mechanism for a deicing unit according to claim 1, further comprising a second adjustment mechanism, and the suspension boom is in number of two, wherein the second adjustment mechanism comprises a cross shaft, fixation seats, a boom transverse arm, balance springs, and a pressure transmission adjusting assembly;

two opposite ends of the cross shaft are provided with the fixation seats respectively, and other two ends of the cross shaft are rotatably connected with middle portions of the two suspension booms respectively;

one end of each of the suspension booms is rotatably connected with the suspension bracket, and other end of each of the suspension boom is connected with one end of the boom transverse arm;

the pressure transmission adjusting assembly is arranged at one side of the boom transverse arm close to the main frame;

one end of each of the balance spring is fixedly arranged on the main frame, and other end of each of the balance spring is arranged opposite to a respective end of the boom transverse arm;

the fixation seats are fixedly arranged on the main frame; one side of the cross shaft away from the main frame is rotatably connected with one end of the hydraulic cylinder;

the boom transverse arm is provided thereon with limit adjusting bolts; and the limit adjusting bolts are each arranged opposite to the respective balance spring.

10. The adjustment mechanism for the deicing unit according to claim 9, wherein the pressure transmission adjusting assembly comprises an adjusting plate and an adjusting block;

the adjusting block is semicircular;

the adjusting block is fixedly arranged on the main frame;

the adjusting block has an arc surface arranged at one side close to the boom transverse arm;

the adjusting plate is an arc-shaped plate; and one side of the adjusting plate is fixedly arranged on the boom transverse arm, and other side of the adjusting plate abuts against the arc surface of the adjusting block.

11. A deicing unit, comprising a main frame, a driving spindle, a driving motor, at least one deicing wheel, a plurality of deicing blades, and the adjustment mechanism according to claim 1, wherein the driving motor is arranged at one end of the driving spindle and fixedly arranged on the main frame;

each deicing wheel is coaxially and fixedly arranged on the driving spindle;

the plurality of deicing blades are evenly arranged in a circumferential direction of the deicing wheel with an axis of the deicing wheel as a central axis;

the upper end cover is fixedly arranged on the main frame; and an axis of the positioning wheel is parallel to an axis of the driving spindle.

12. The deicing unit according to claim 11, wherein the plurality of deicing blades each comprise a connecting shank and a blade head;

one end of the connecting shank is rotatably connected with the deicing wheel;

other end of the connecting shank is fixedly connected with a side portion at one end of the blade head; and other end of the blade head is provided with a tip.

13. The deicing unit according to claim 12, wherein each of the deicing blades further comprises a fixation beam;

the blade head comprises a plurality of blade heads, and the plurality of the blade heads are evenly arranged at a same side of the fixation beam along a thickness direction of the deicing wheel;

the connecting shank comprises two connecting shanks, and the two connecting shanks are both arranged at one side of the fixation beam away from the blade heads;

one side of each of the blade heads away from the connecting shank is in a shape of an arc; and a chord length direction of the arc is perpendicular to a thickness direction of the deicing wheel.

14. The deicing unit according to claim 13, wherein each of the deicing blades further comprises a scraping bar; and the scraping bar is arranged at one sides of the blade heads away from the fixation beam, and configured to connect the plurality of blade heads.

15. The deicing unit according to claim 14, wherein one side of the scraping bar away from the fixation beam is arc-shaped; and a chord length direction of the scraping bar is parallel to a chord length direction of each of the blade heads, and the scraping bar and each of the blade heads have same radian.

16. The deicing unit according to claim 11, wherein the deicing wheel is provided with a plurality of lightening holes; and the lightening holes are evenly arranged with the axis of the deicing wheel as a central axis.

17. The deicing unit according to claim 12, wherein the connecting shank is provided with a returning device; and the returning device is connected with the connecting shank and the deicing wheel, and is capable of making the connecting shank return from a position where the connecting shank reaches under action of external force to an original position.

18. A deicing method using a deicing vehicle, wherein the deicing vehicle comprises a vehicle body, a first regulating mechanism, a second regulating mechanism, and at least one deicing unit according to claim 13, the at least one deicing unit is arranged in front of the vehicle body through the first regulating mechanism and the second regulating mechanism, and is capable of performing a deicing operation when being driven by the vehicle body, the first adjustment mechanism comprises a suspension bracket, a hydraulic cylinder, a hydraulic cylinder transverse arm, at least one first sub-adjustment unit and a suspension boom, each first sub-adjustment unit comprises a main adjustment spring, a main adjustment screw rod, a main adjustment nut and a spring base, one end of the hydraulic cylinder is rotatably connected with the deicing unit, and other end of the hydraulic cylinder is rotatably connected with the hydraulic cylinder transverse arm, the main regulating screw rod has one end passing through the suspension bracket and is slidably connected with the suspension bracket, one end of the main regulating screw rod is fixedly connected with the hydraulic cylinder transverse arm, and other end of the main regulating screw rod is slidably connected with the spring base, the main regulating spring is sleeved outside the main regulating screw rod, and one end of the main regulating spring abuts against the spring base, and the other end of the main regulating spring abuts against the suspension bracket, and the main regulating nut is arranged at one end of the main regulating screw rod and is arranged at one side of the spring base away from the main regulating spring; and the method comprises:

controlling the vehicle body to make the deicing unit close to ground;

controlling the hydraulic cylinder to make a hydraulic rod of the hydraulic cylinder extend out from a top dead center, such that the positioning wheel is in contact with the ground, and the deicing blades are not in contact with the ground;

controlling the hydraulic cylinder to make the hydraulic rod of the hydraulic cylinder continue to extend out, such that the positioning wheel adjustment spring is gradually compressed, and the deicing blades are close to the ground; and controlling the hydraulic cylinder to make the hydraulic rod of the hydraulic cylinder continue to extend out, such that an overall weight of the deicing unit is completely borne by the positioning wheel and the suspension boom.

19. The deicing method according to claim 18, further comprising:

controlling the hydraulic cylinder to make the hydraulic rod of the hydraulic cylinder retracted back to the top dead center, so that the positioning wheel is suspended; and controlling the vehicle body to switch the deicing unit to another site.

* * * * *